United States Patent [19]

Simpson et al.

[11] 4,074,492

[45] Feb. 21, 1978

[54] PREFABRICATED WATERTIGHT STRUCTURAL SYSTEM

[75] Inventors: Harold G. Simpson; Michael W. Davis, both of Oklahoma City, Okla.

[73] Assignee: Star Manufacturing Co. of Oklahoma, Oklahoma City, Okla.

[21] Appl. No.: 645,565

[22] Filed: Dec. 31, 1975

[51] Int. Cl.[2] ..... E04B 2/08

[52] U.S. Cl. ..... 52/419; 52/520; 52/544; 52/509; 24/201 C

[58] Field of Search ..... 52/419, 509, 750, 753 D, 52/758 J, 758 D, 744, 520, 544; 151/38; 85/1 JP, 70, 71, 21; 24/201 C; 277/166; 404/40

[56] References Cited

U.S. PATENT DOCUMENTS

| | | | |
|---|---|---|---|
| 1,686,106 | 10/1928 | Saives | 52/758 D |
| 2,756,172 | 7/1956 | Kidd | 24/201 C |
| 2,769,212 | 11/1956 | Hammitt et al. | 52/509 |
| 2,791,807 | 5/1957 | Morin | 24/201 C |
| 2,850,936 | 9/1958 | Poupitch | 85/71 |
| 2,871,539 | 2/1959 | Swan | 24/201 C |
| 2,884,099 | 4/1959 | Nenzell | 52/758 D |
| 2,927,497 | 3/1960 | Rapata | 85/21 |
| 3,646,720 | 3/1972 | Watts | 52/744 |
| 3,664,676 | 5/1972 | Petersen | 277/166 |
| 3,909,998 | 10/1975 | Simpson et al. | 52/509 |

FOREIGN PATENT DOCUMENTS

| | | | |
|---|---|---|---|
| 998,463 | 12/1951 | France | 404/40 |
| 1,240,036 | 7/1960 | France | 85/71 |

OTHER PUBLICATIONS

A. Renfrew & Phillip Morgan, Polythene, The Technology and Uses of Ethylene Polymers, London: Iliffe & Sons Ltd., 1963, pp. 397–405.

*Primary Examiner*—James L. Ridgill, Jr.
*Attorney, Agent, or Firm*—Hubbard, Thurman, Turner, Tucker & Glaser

[57] ABSTRACT

A prefabricated panel system which can be erected to form a watertight surface suitable for use as the roof or wall of a building is disclosed. Each panel of the system includes a structural portion having a flexible membrane covering, a foam center member, a corrugated metal panel extending beyond the foam center and the surface of the panel assembly, and elongated, flexible fastener halves disposed along each edge of the flexible membrane. The panels are assembled together in edge-to-edge relationship with the fastener halves engaged to provide a continuous waterproof membrane extending across the joint between adjacent panels. Interstitial regions defined by the junction of adjoining panels are sealed to complete the waterproof membrane. This seal is provided by a viscous adhesive sealing material which is caused to flow into the interstitial regions by compressive means.

8 Claims, 25 Drawing Figures

PREFABRICATED WATERTIGHT STRUCTURAL SYSTEM

BACKGROUND OF THE INVENTION

1. Field of the Invention

This invention relates generally to prefabricated structural systems utilizing a plurality of side-by-side panels to provide a continuous fluid-tight membrane, and more specifically relates to such a structural system particularly suited for roofs of buildings, or other exterior or interior walls requiring a continuous fluid-tight membrane with superior structural strength, and good insulating and fire resistance properties adequate to meet building codes. In one of its aspects it relates to a joint assembly for sealing the intersection of two or more panels in the system to provide the fluid-tight membrane.

2. Description of the Prior Art

Conventional built-up roofing systems have been employed for many years. In this method of construction, a horizontal roof deck typically corrugated deck and insulation, planking or plywood, is supported on underlying structural beams. The entire roof deck is covered by a continuous weatherproof membrane usually comprising alternate layers of felt and bitumen to prevent penetration of moisture into the building interior. The membrane is applied in a field operation by application of alternate layers of hot or cold bitumen and felt. Once the membrane is applied to the desired thickness, gravel, rock or similar aggregate material is spread upon the roof to provide ballast to hold the roof down against wind generated uplift and protection against weathering. To reduce heat transfer through the roof deck, insulation is often applied to the underside of the roof deck at the interior of the building. Insulation may also be applied on the exterior of the roof deck and subsequently covered with the water resistance membrane and ballast rock.

There are many difficulties with built-up roof systems of the type described above. Since the construction of the built-up roof is entirely a field operation, there is little uniformity of quality from one building to another and consequently the integrity of such a roof structure varies considerably. A built-up roof membrane has a tendency to bubble and crack. This deterioration results from a number of factors including expansion and contraction from severe temperature changes, moisture trapped below the water resistant membrane, and improper construction techniques. Further, built-up roofs do not readily withstand heavy foot traffic and are susceptible to damage from traffic. Also considerable safety and environmental hazards exist in the application of hot tar which often gives off toxic fumes and polluting matter. Because of the undesirable nature of the hot tar process, local and federal safety and pollution standards often prohibit or restrict the use of built-up systems which formerly had wide acceptance.

In co-pending applications Ser. No. 336,370, filed Feb. 27, 1973, now U.S. Pat. No. 3,909,998, and Ser. No. 336,364, filed Feb. 7, 1973, both of which are assigned to the assignee of the present invention, both disclosures of which are hereby incorporated in this application by reference, a prefabricated panelized roofing system is described and claimed which employs Hypalon membrane panels having superior weathering characteristics as a top surface on prefabricated panels capable of spanning spaced substructural members.

These panels include extruded Hypalon fasteners along the edges of the Hypalon membranes which can be engaged after the panels are arrayed in a roof structure and fastened to the underlying structure to form a continuous watertight membrane when the intersection of four sides is properly sealed. In order for such a system to be commercially successful, various governmental building code requirements, Underwriters Laboratory ratings, and manufacturers association ratings must be met. The panels must have the ability to withstand catastropic failure due to wind uplift, general load bearing ratings, fire ratings for both resisting and containing an interior fire, and for resisting flying embers from adjacent buring buildings. In addition, the panels must have a good U-factor, i.e., insulation rating. Because one face of each panel is exposed to the interior of a building, with a relatively stable temperature, while the other surface is an exterior surface of the building, the panel must be able to withstand relatively large, highly cyclical thermal stresses. In addition, such panels must be economical and repeatedly manufacturable on a production line and must require minimum field erection labor and skill. Such a system must also be erectable in adverse temperature and moisture conditions.

In co-pending United States patent application Ser. No. 624,587, filed Oct. 22, 1975, a panel system is disclosed which has high strength but light weight so that it can be manually lifted. The panels have superior weathering qualities, are reliably fluid-tight, and can be easily and quickly erected in a wide variety of weather conditions with minimum labor and skill. They also provide a strong and convenient platform for workmen during all states of erection, have good resistance to fire resulting from flying embers on the top surface, have superior insulating properties, can withstand extreme temperature cycling, have a relatively economically manufactured with a minimum capital investment and minimum transportation cost. The panels also serve as a stable, flat base for accessories and penetrations, and are high resistant to handling and erection damage.

In accordance with that invention, a prefabricated panel is provided which comprises a Hypalon membrane intimately bonded to a metal sheet by an epoxy adhesive. This combination provides a surface which has superior weathering characteristics and is highly resistant to most corrosive agents and is resistant to penetration by sharp objects, resists wear and deformation due to heavy foot traffic, and provides high tensile strength to resist wind uploads when the edges of the panel are fastened to a supporting structure. Extruded Hypalon fasteners bonded along the edges of the Hypalon membrane with a flexible web and extending over the edges of the panel which are fastened to the supporting structure provide a continuous waterproof membrane across adjacent panels except for the corner joints which is then sealed by means of a Hypalon putty material formed by dissolving Hypalon in a suitable solvent, such as toluene, which upon evaporation leaves a solid mass of Hypalon material bonded to the fastener halves and to the exposed surface of the Hypalon membrane. The solvent in the dissolved material also dissolves the surface of the Hypalon fasteners as well as the Hypalon membrane to provide an intimate bond, and the resulting mass of Hypalon is subsequently fixed by the radiation from the sun and finally by the passage of time to provide an integral chemical seal for the corner joint. Also, the ends of the joint between the fastener halves is exposed to ready access to the dissolved Hypalon material so that the ends of the capillaries extending along the length of the fastener grooves are sealed. Also, all other paths leading along the surfaces of the various overlapped layers of Hypalon materials are similarly sealed. As noted in that application, alternatively, a mechanical device can be used to compress a mastic into the area defined by the corner joint to seal the capillaries and form a peripheral surface dam.

SUMMARY OF THE INVENTION

The present invention is directed to the apparatus, and methods of utilizing same, for providing the required mechanical joint. Thus, in accordance with this invention, various forms of clamps are illustrated for applying the mastic as described by squeezing and compressing the mastic so that it will flow into the areas to be sealed. The clamp preferably includes a lower plate which may be placed under the ends of the fasteners at the corner joint, a top plate to which the mastic may be applied including an outer relatively stiff donut to retain the sealing mastic when it is compressed such as by a clamp having a top and bottom plate. The clamp includes means, such as an expansion bolt for clamping the plates together to compress to mastic and cause it to flow into the areas to be sealed. Also, a chemical seal comprising a Hypalon putty is disclosed which may be used to seal the corner joint without the use of a mechanical clamp. The features of this invention are set forth in various combinations and subcombinations such as have distinct and separate utility in the appended claims.

BRIEF DESCRIPTION OF THE DRAWING

The novel features believed characteristic of this invention are set forth in the appended claims. The invention itself, however, as well as other objects and advantages thereof, may best be understood by reference to the following detailed description of illustrative embodiments, when read in conjunction with the accompanying drawings, wherein:

DETAILED DESCRIPTION

Figure 1:
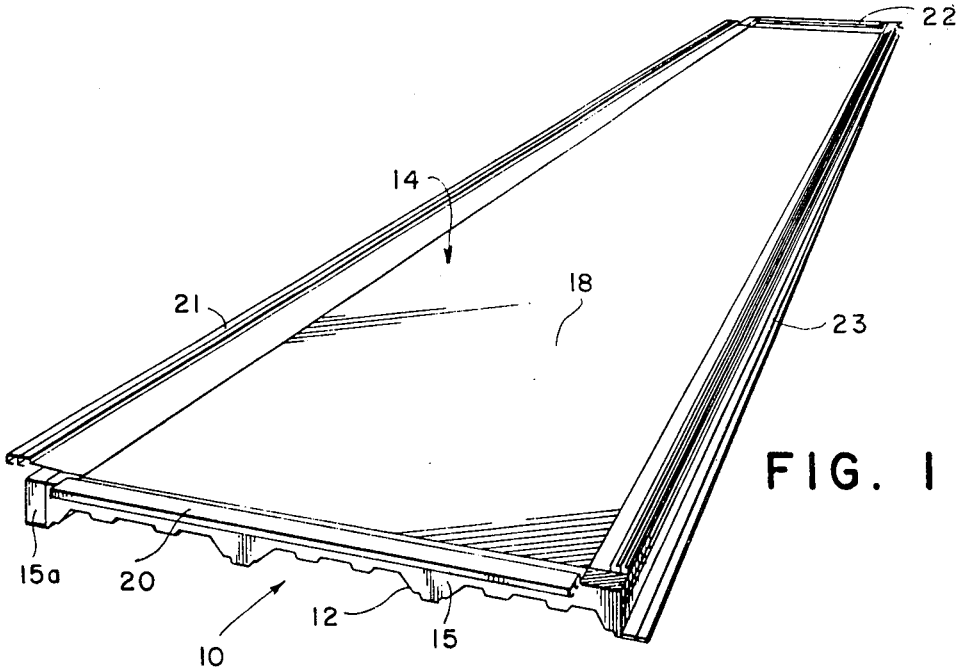
FIG. 1 is a perspective view from one end of a panel in accordance with the present invention.

Referring now to the drawings, a panel in accordance with the present invention is indicated generally by the reference numeral 10 in FIG. 1. The panel 10 is typically about three feet wide and from twenty to forty feet in length. The panel as illustrated in FIG. 1 can be completely prefabricated at one or more assembly line type factories prior to transportation to an erection site. The panel is designed to require minimum field labor for erection and yet to produce a reliable watertight roof, ceiling or wall system, either interior or exterior, where a fluid-tight membrane is required. As can best be seen in FIG. 2, the panel 10 includes a corrugated sheet metal subpanel 12 which provides structural strength for spanning between two spaced structural beams, commonly Z-shaped purlins or bar joists, a top subpanel assembly 14, and a foam insulating layer 15 sandwiched between the subpanels 12 and 14 as a result of being foamed in place, a metal sheet 16 on top of foam layer 15, and a membrane covering sheet 18 bonded to sheet 16 such as by epoxy. Membrane 18 is a thin colandered sheet of synthetic material having exceptional corrosion resistance and weathering properties when exposed to sun, heat, cold, moisture, chemicals and atmosphere pollutants. However, colandered material, particularly thin sheets, often does not provide a watertight surface because of small pin holes and other slight imperfections. Also, the material may not have exceptional mechanical strength and may tend to be subject to creeping when placed under external loads until such time as it has been fully cured by the passage of considerable time. Alternatively, the steel sheet 16 may have very poor weathering characteristics as a result of oxidation of rusting, however non-galvanized or otherwise untreated sheet steel has high tensile strength and sufficient stiffness to prevent deformation, particularly when backed by the foam insulation or a nearly solid deck and prevents puncture of membrane 18. The epoxy adhesive between membrane 18 and sheet 16 provides good adhesive strength and also good weather and corrosion resistance, but otherwise may be subject to mechanical abrasion and chipping. As a result of the combination of the metal sheet 16, the membrane 18 and the epoxy adhesive, an unusually appropriate surface is provided.

Membrane 18 preferably comprises an elastomer such as a natural or synthetic rubber, or plastic, bonded or adhesively joined to the surface or metal sheet 16. Membrane 18, for example, may be a cholorsulfonated polyethylene material such as a material known under the tradename "Flex Seal" B. F. Goodrich Tire & Rubber Comapny or "Hypalon" a tradename of E. I. Dupont de Nemous Co., or a filled "Hypalon" material as hereinafter defined. Other material such as a flexible, light gauge aluminum or galvanized sheeting may be used as a material for the membrane.

Fasteners 20-23 are positioned along the four edges of the panel 10 and are thermally welded or otherwise bonded to membrane 18 as generally illustrated in FIG. 1. As can best be seen in FIG. 7, the fastener half 21 has a tongue and groove portion 21*a* of the general type described in co-pending patent application Ser. No. 445,498, filed Feb. 25, 1974, now U.S. Pat. No. 3,935,682, entitled "Cleaning Fasteners", and assigned to the assignee of the present invention, which is hereby incorporated by reference, including a web portion 21*b*. The web portion 21*b* is preferably thermally bonded, i.e., vulcanized, to the membrane 18 along its entire length. It will be noted that the grooves 21*a* face downwardly. Fastener means 23 along the opposite edge of the panel similarly has a groove portion 23*a* which faces upwardly, and a web portion 23*b* which is thermally bonded to membrane 18 as previously described. The fastener halves 20 and 22 are identical to the fastener halves 21 and 23 and have webs bonded to membrane 18 in the same manner.

Fastener 20–23 may be made of the same flexible material as membrane 18 and preferably should have at least the following characteristics:

1. It can be formed such as by extrusion as an integral piece, including the body and web portion;
2. The web portion should be adaptable to be easily and securely bonded to membrane 18 such as by the application of heat and pressure;
3. The body portion should be adapted to be stiffened and permanently set in a desired shape and be sufficiently resilient to permit it to be distorted from the permanently set shape if required for insertion into a similar fastener and then returned to that shape;
4. It should have good weathering characteristics in all types of environments to permit it to be used in outdoor service, and be adapted to be fireproofed,
5. It should have good tensile and compressive strength to permit it to be walked over and subjected to high wind loads, and
6. It should be of a pleasing color or adapted to be made of such a color.

It has been found that the referred to "Hypalon" or "filled Hypalon" material meets all of these requirements and is preferred as the material for fasteners 20–23.

As used in this application, the term "Hypalon" or "filled Hypalon" shall mean a material that includes as major ingredients, chlorosulfonated polyethylene, at least one stable polymer extender or filler and various processing and milling aids if desired. Any inert filler material such as titanium-dioxide, carbon-black, ground clay and the like can be utilized as the polymer extender. Various processing and milling aid materials that are compatible with the chlorosulfonated polyethylene material can be utilized in the instant compositions that are referred to as "Hypalon" and "filled Hypalon" throughout this specification. Normally, the chlorosulfonated polyethylene will be in an unvulcanized state.

Figure 2:
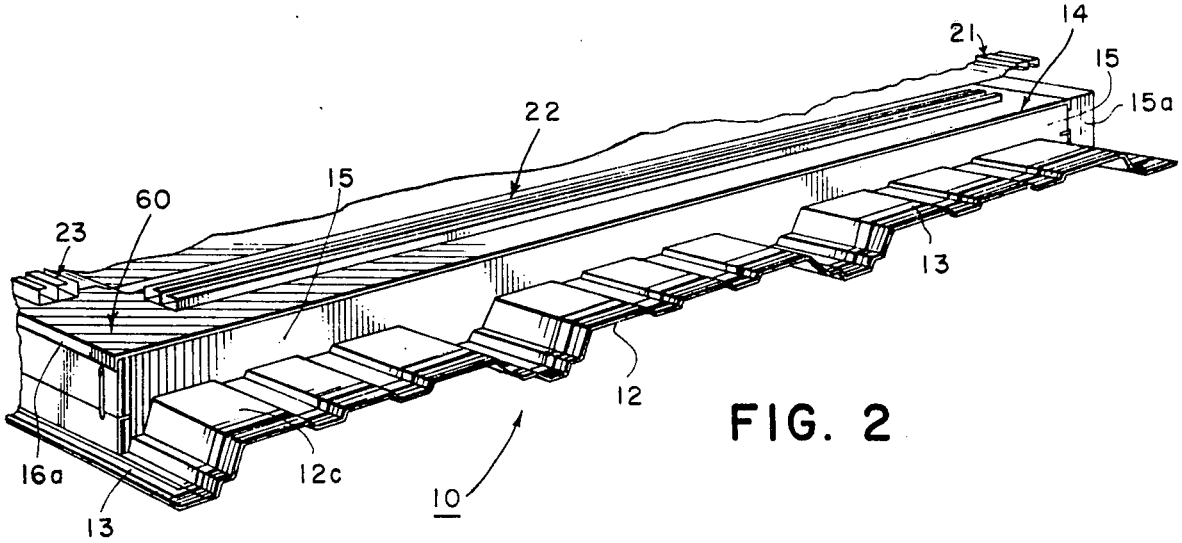
FIG. 2 is an enlarged perspective view of the opposite end of the panel of FIG. 1.
Figure 3:
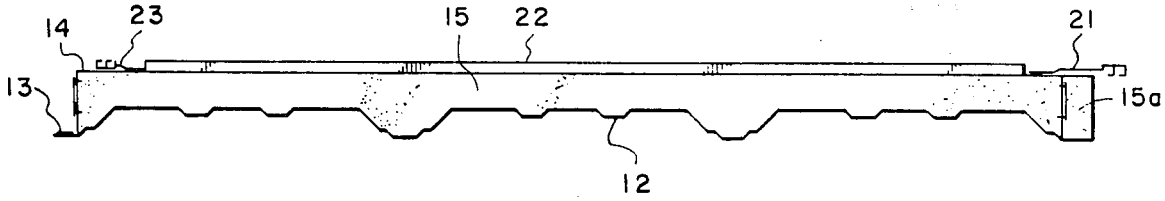
FIG. 3 is an elevational view of the end of the panel shown in FIG. 2.
Figure 4:
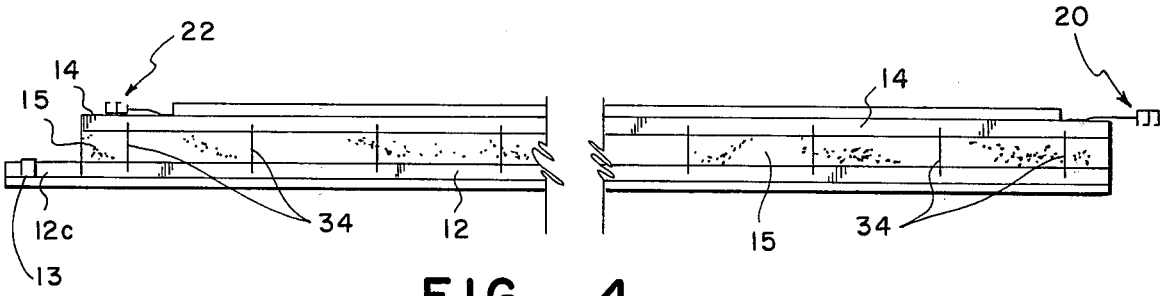
FIG. 4 is a fragmented side elevational view of the panel of FIG. 1 with the center portion omitted.

As can best be seen in FIG. 2, the sheet metal sub-panel 12 extends beyond one end of the sub-panel assembly 14 to provide a lip 12*c*. The other end of the sub-panel 12 terminates at the same point as the sub-panel assembly 14. On the other hand, it will be noted that ends of the foam insulating layer 15 are aligned with the end of the sub-panel assembly 14 at both ends.

A closed cell foam sealing strip 13 is attached to the top surface of the lip 12*c* and along the top of rolled edge 12*b* by a pressure sensitive adhesive to provide a vapor barrier near the interior surface of the roof assembly when the panels are installed, and thus prevent condensation between the panel edges when the exterior surface is colder than the interior surface. Membrane 18 serves as a vapor barrier when the temperature differential is reversed.

A filler or insert 15*a* formed of the same or similar foam material as the foam layer 15 overlies the rolled edge 12*a* of the sub-panel 12 as shown in FIGS. 1 and 2, in order to fill the space between the adjacent panels when installed. Insert 15*a* is installed at the prefabrication site in the position illustrated in FIGS. 1 and 2 and secured in place by any suitable manner, such as by a plurality of conventional staples (now shown).

Figure 5:
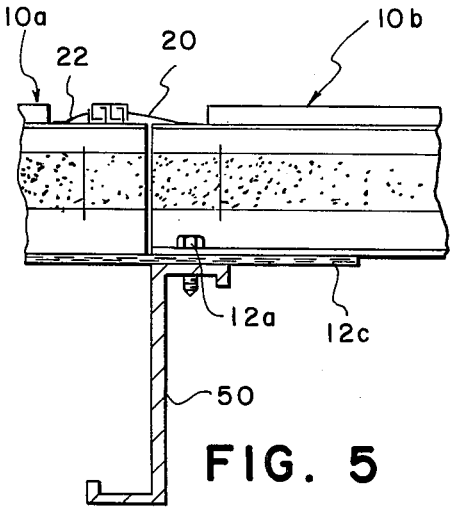
FIG. 5 is a side view of portions of a plurality of panels interconnected in end-to-end relationship and bridging across transversely extending substructural beams to form an assembled structure in accordance with the present invention.
Figure 6:
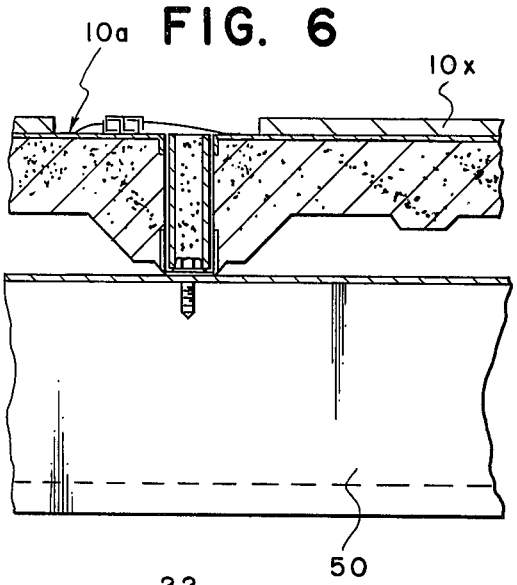
FIG. 6 is a sectional view extending transversely of the panels showing a plurality of panels interconnected as illustrated in FIG. 5.

Panels 10 are erected edge-to-edge as illustrated in FIGS. 5 and 6 to provide a building structure. As can best be seen in FIG. 5, panels 10 are positioned transversely across parallel structural beams commonly referred to as Z-shaped purlins 50 of a substructure adapted to support the load of the panel system together with wind, water and snow loads in the conventional manner. This substructure may be of any design so long as the structure provides support extending transversely of the panels at longitudinally spaced intervals, or, of course, continuously. As illustrated, the extension 12*c* of panel 10*a* is positioned over a purlin. The flat end of panel 10*b* is then nested in the corrugated extension 12*c* so that the fastener half 20 of a panel 10*b* can be mated with the fastener half 22 of panel 10*a*. A plurality of purlins are normally disposed at intervals of four to eight feet along the length of the panel 10*b*. The extension 12*c* of panel 10*b* is also shown as being positioned over a purlin 50, although such positioning is not essential. After one or more of the panels 10*a*–10*b* are layed end-to-end as illustrated in FIG. 5, panels 10*x* and 10*y* may then be placed side-by-side with the panel 10*a* as illustrated in FIG. 6.

Figure 7:
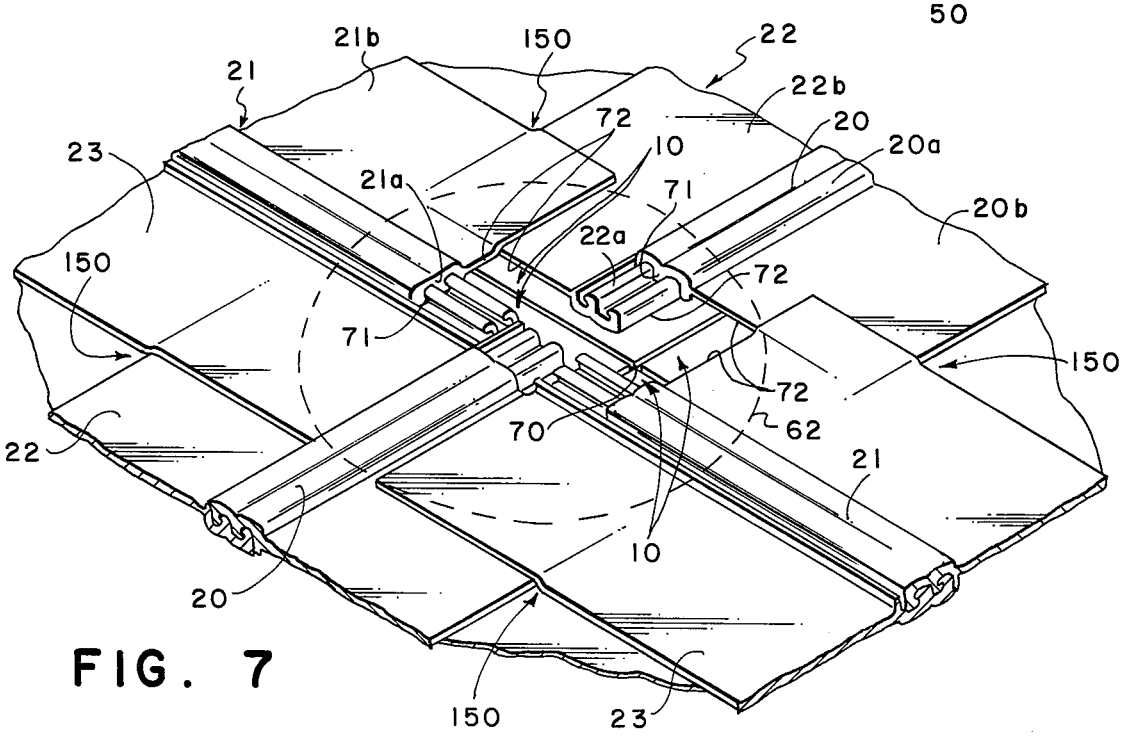
FIG. 7 illustrated the configuration of the lateral strip fastener halves at the common corners of four adjacent panels of the system of FIGS. 5 and 6.
Figure 9:
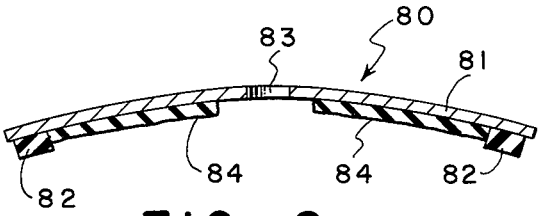
FIG. 9 is a sectional view taken at 9—9 in FIG. 8.

After the edges of all of the panels are fastened to the underlying purlins 50, the fastener halves 20–23 can be mated along all adjacent edges on all panels. This results in a continuous fluid-tight membrane except for the corner joints such as illustrated in FIG. 7, which form an opening 70 in the solid membrane cover provided by the construction system described. It will be noted that the upwardly facing fastener halves 22 and 23 extend beyond the downwardly facing fastener halves 20 and 21. It will also be appreciated that the opening 70 overlies the corner 60 of the panel as illustrated in FIG. 2 which is covered with membrane 18.

The present invention is directed toward means for sealing the opening illustrated in FIG. 7, and in particular the ends of the capillaries (represented generally by reference numeral 71) extending along the length of the fastener grooves, and the junctures of all other membrane and web surfaces such as generally represented by the reference numeral 72.

In accordance with this invention, and as illustrated in FIG. 7–22, various forms of clamps are provided for applying a compressible mastic in the area defined by the dotted line 62 and for sealing in the areas referred to by reference numerals 71 and 72.

A preferred form of this clamp 80 is illustrated in FIGS. 8–11 as including an upper dome-shaped plate 81 to which a relatively stiff donut 82 of butyl or similar sealing material is applied. Upper plate 81 includes a center hole 83 and a quantity of mastic sealing material 84, such as butyl but with a lower viscosity than the donut material 82 is applied to the to the bottom surface of plate 81 as indicated by the reference numeral 84 in FIGS. 8 and 9. In this manner the stiffer donut 82 will serve as a dam to prevent the softer material from flowing outside the periphery of plate 81 when it is pressed down on the upper surface of a four corner joint such as shown in FIG. 7. The softer butyl or mastic material must be thick enough to be applied to the lower surface of plate 81 prior to installation, but thin enough to readily flow when compressed to provide the required seal. Of course, other materials of similar properties to butyl may be used for both the donut 82 and the softer mastic material 84.

Figure 10:
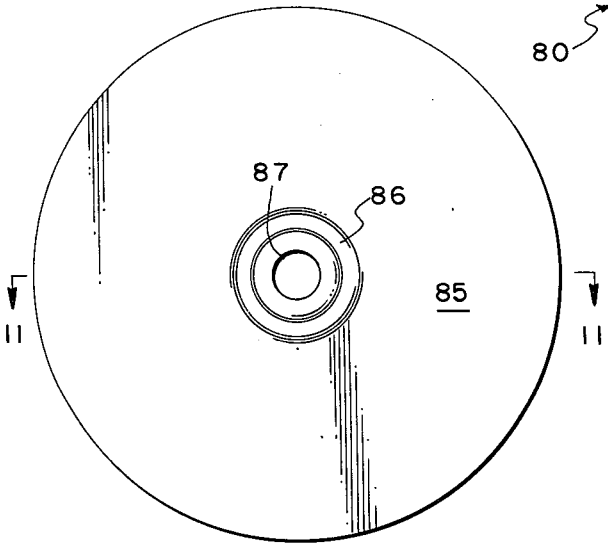
FIG. 10 is a top view of a preferred form of bottom plates for the clamp of this invention.
Figure 11:
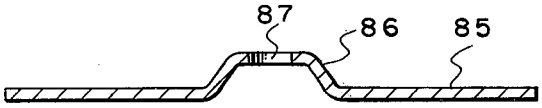
FIG. 11 is a sectional view taken at 11—11 in FIG. 10.
Figure 12:
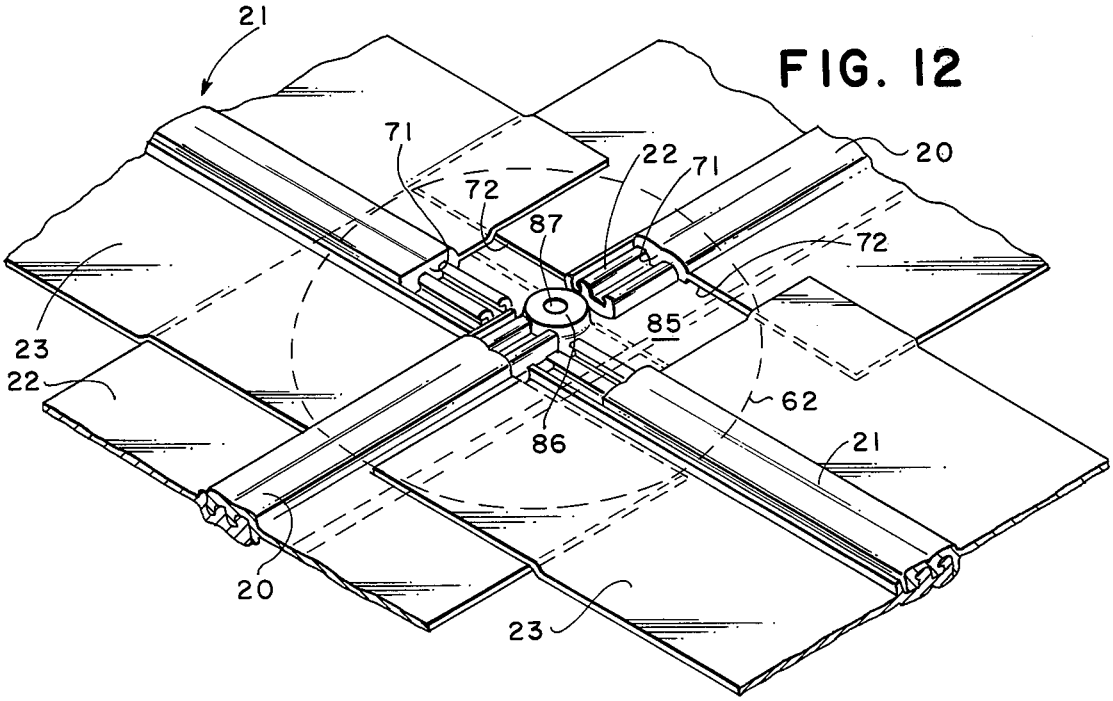
FIG. 12 is a view similar to FIG. 7, but with the bottom plates of the clamp in place.

FIGS. 10 and 11 illustrate a circular lower plate 85 which together with plate 81 form the referred to preferred form of clamp of this invention. As illustrated in FIG. 11 the center portion 86 of plate 85 is raised and includes an opening 87 through it. During the process of installation of the clamp of FIGS. 8 and 11, the ends illustrated in FIG. 7 of fasteners 20, 21 and 22, and 23 are maintained loose so that they can be lifted up to permit plate 85 to be inserted under them, and then permit them to fasten together as shown in FIG. 12. As illustrated in FIG. 12 center raised portion 86 of plate 85 extends upwardly from plate 85 and functions to prevent upper plate 81 from being pulled down where it will crush or deform the ends of the fasteners, thus, in all probability, causing them to leak.

Figure 13:
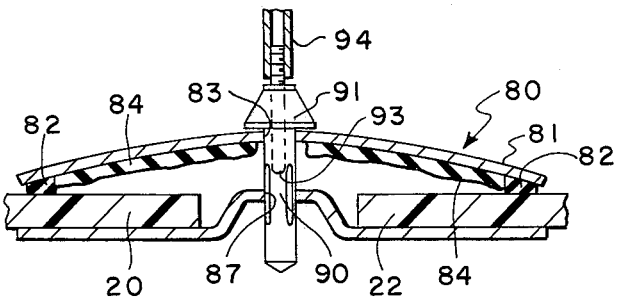
FIG. 13 is a sectional view illustrating the relationship of the clamp halves just prior to forcing them together.
Figure 14:
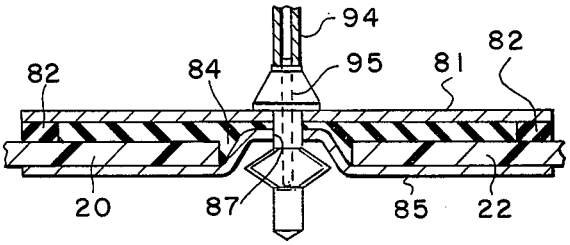
FIG. 14 is a sectional view illustrating the relationship of the clamp halves when forced together.
Figure 15:
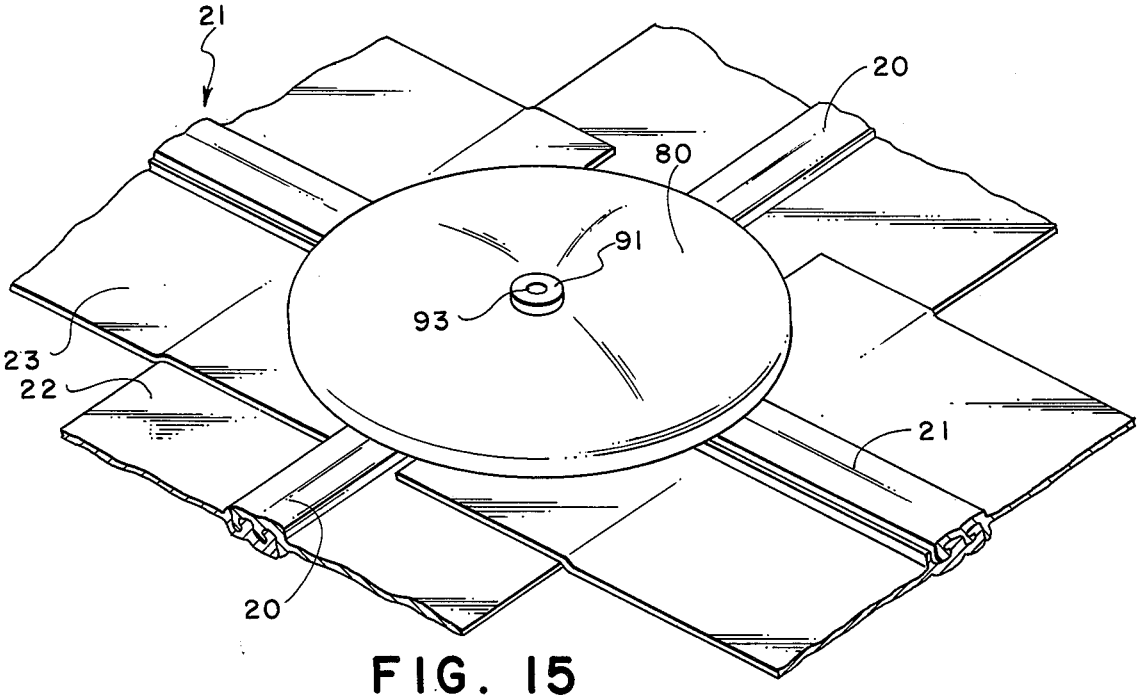
FIG. 15 is a view similar to FIG. 7 but with the top plate of the clamp installed.

FIGS. 13, 14 and 15 illustrate the manner in which the clamp of FIGS. 8 through 11 is connected to apply the mastic on the bottom of plate 81 in the opening 70 illustrated in FIG. 7. For the purpose of clamping and forcing plates 81 and 85 together, an expansion bolt 90 including a heat 91 is passed through openings 83 and 87, which are aligned as illustrated in FIG. 13 with fasteners 20 and 22 between the respective plates. Bolt 90 includes a center opening and pulling pin 93 is passed through this opening and thus the center of expansion bolt 90. A pulling tool 94 may be mounted on top of the bolt as illustrated in FIGS. 13 and 14 and the bolt is designed so that then the pin is pulled upwardly the lower portion of the bolt, extending through opening 87 in plates 85, will collapse and expand outward as illustrated in FIG. 14, pulling plate 85 and plate 81 together. As this occurs, and plate 81 is partially flattened as illustrated in FIG. 14, the soft mastic material 84 is compressed and caused to flow into the capillaries (generally represented by numeral 71 in FIG. 7) and the junctions of all other membrane and web surfaces (as generally represented by reference numeral 72 in FIG. 7). As noted, the stiffer donut 82 of butyl material functions to prevent the flow of the softer mastic material outside the periphery of the clamp and to insure that the flow is into the capillaries and junctures which require sealing. When the clamp has been secured as in FIG. 14 with plates 81 and 85 drawn together, pin 93 may be broken off substantially flush with the bolt head 91.

FIG. 15 illustrates the completed corner structure with top plate 81 of the clamp illustrated in place.

Figure 16:
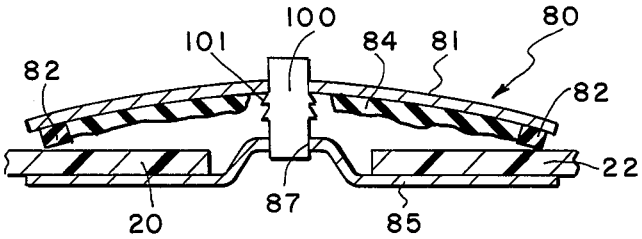
FIG. 16 is a sectional view illustrating another form of clamp just prior to being forced together.
Figure 17:
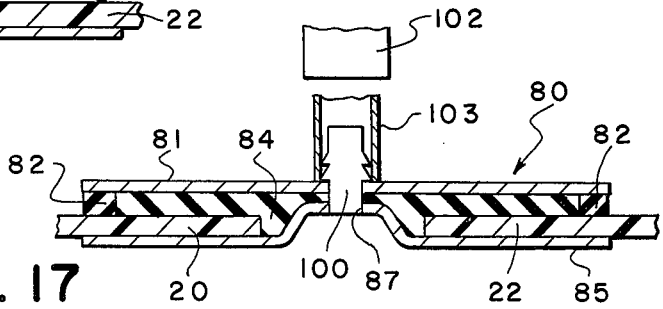
FIG. 17 illustrates the clamp of FIG. 16 when forced together.

Referring now to FIGS. 16 and 17, another form of clamp of this invention is illustrated which includes plates 81 and 85 and is identical to the structure of FIGS. 8 through 15 with the exception of the configuration of the bolt used to draw the plates of the clamp together. As illustrated in FIG. 16 an upstanding stud 100 is mounted in opening 87 of lower plate 85 and includes a plurality of collapsible barbs 101 about the periphery. Thus, when plate 85 is installed as illustrated in FIG. 12 under the ends of fastener 20, 21, 22 and 23, stud 100 will project upwardly from plate 85 so that plate 81 can be placed on it and driven as such by a hammer 102 striking a sleeve 103 until top plate 81 has been forced to pass barbs 101 to the position of FIG. 17 compressing the softener material and providing the sealing function in the manner described with respect to FIGS. 14 and 15.

Figure 18:
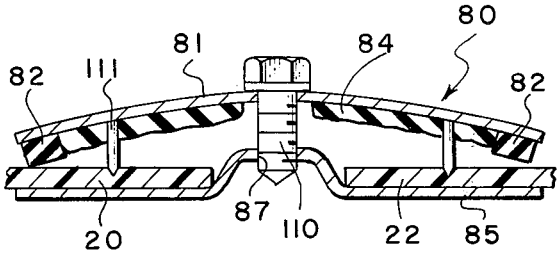
FIGS. 18 and 19 illustrate the operation of another form of clamp of this invention.
Figure 19:
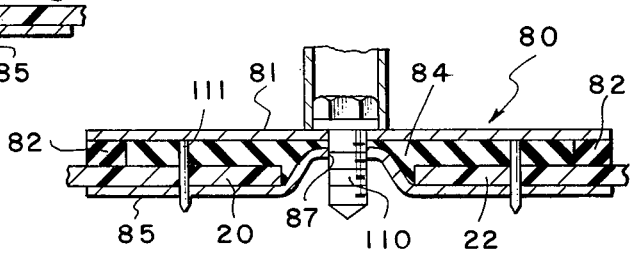

Referring now to FIGS. 18 and 19, still another form of the clamp of this invention is illustrated as including an end top plate 81, with the relatively stiff donut of butyl material 82 and soft mastic material 84, and lower plate 85. However, in this embodiment a threaded bolt 110 is utilized to draw the plates together and for this purpose opening 87 may be threaded or bolt 110 be self tapping. In this embodiment bolt 110 must be rotated in order to cause the plates to be drawn together and this rotation can cause rotation of the plates of the clamp with respect to each other. For preventing this, which could distort the fastener between the plates, and cause leakage, one or more downwardly projecting, pointed barbs 111 may be provided on the lower surface of upper plate 81 for penetrating into plate 85 when plates 81 and 85 are drawn together to prevent the relative rotation of the plates. Plates 85 may be made of a relatively soft metal such as aluminum to permit it to be punctured as the plates are drawn together as illustrated in FIG. 19. Again the soft mastic material is compressed between the plates when they are drawn together to provide the sealing function as previously described.

Figure 20:
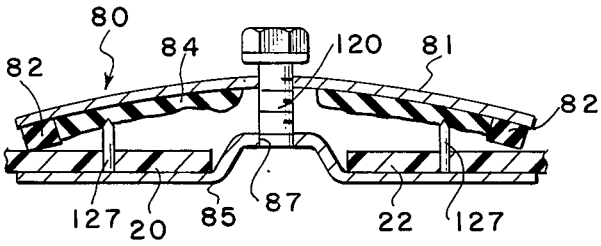
FIGS. 20 and 21 illustrate the operation of still another form of clamp of this invention.
Figure 21:
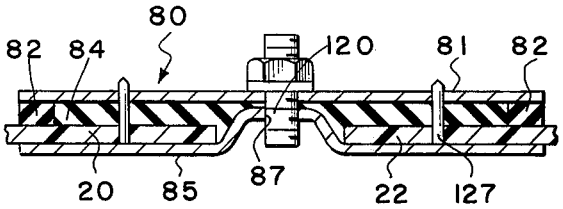

FIGS. 20 and 21 illustrate a clamp similar to that in FIGS. 18 and 19 except that a threaded stud 120 extends from lower plate 85 as do pointed barbs 121 that function to penetrate upper plate 81 in this instance to prevent relative rotation between the plates. As illustrated in FIGS. 20 and 21, a nut 122 may be placed on the upper end of stud 120 and tightened to draw the plates together as illustrated in FIG. 21. Again, in this embodiment as the plates are drawn together the soft mastic material 84 is caused to flow into the capillaries 71 and juncture 72 to provide the desired seal.

Figure 22:
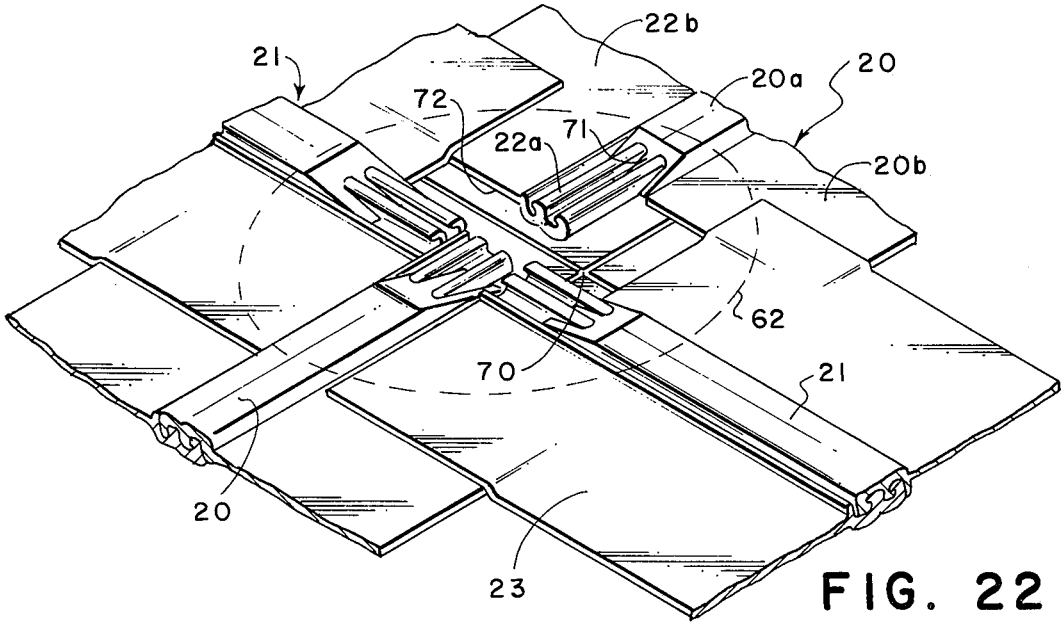
FIG. 22 is a view similar to FIG. 7, but with the ends of the top fastener members being cut on an incline.

When the various clamps illustrated are forced together causing the soft mastic material to flow, it is possible that some of this material may flow under the ends of the fasteners and force them up and distort the connection between the fasteners. In order to reduce this tendency and to provide a larger area to which the mastic may be applied at the ends of the fasteners, the end of the downward facing fasteners 20 and 31 as illustrated in FIG. 22, may be tapered or cut at an angle (such as 30°) so that the length of the juncture between the ends of these fasteners and the fasteners 22 and 23 is increased. Also, as the mastic material is compressed causing it to flow it will apply a force component downwardly against these tapered ends to counter forces tending to lift the ends up to prevent these ends and the ends of fasteners of 22 and 23 from being forced up or to buckle in to insure the integrity of the seal provided at the point of junction.

Figure 23:
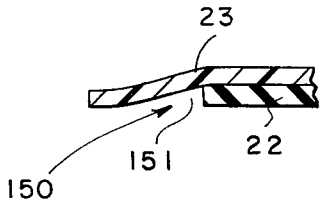
FIGS. 23 and 24 are side views in elevation illustrating the manner in which the web flaps are sealed at their junction.
Figure 24:
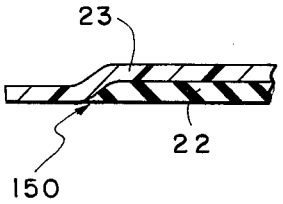

Referring now to FIGS. 23 and 24, in order to insure that water does not enter along the juncture between the respective web portions of the fasteners, which are overlapped (as illustrated by reference numeral 150 in FIG. 7), it is preferred that some device such as a heat gun and a roller (not shown) be utilized to seal the ends of these members at the junctures 150. FIG. 23 illustrates the juncture 150 prior to heat welding as described, with a capillary 151 illustrated as a possible leakage path, and FIG. 24 illustrates the juncture 151 after application of heat and pressure.

Figure 25:
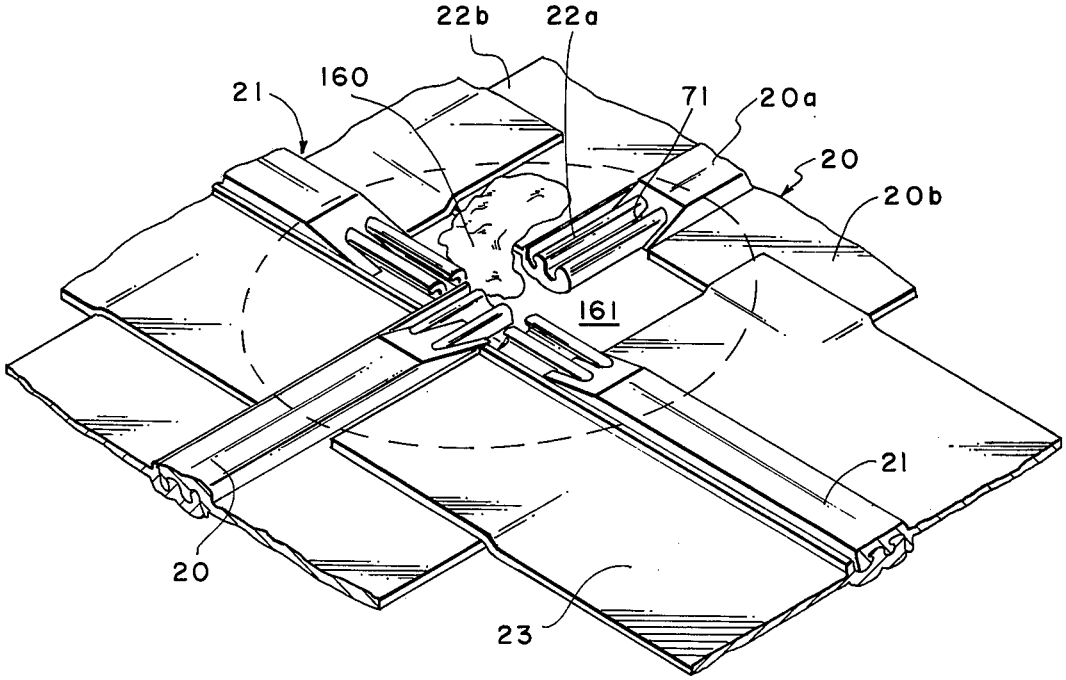
FIG. 25 is a view similar to FIG. 7 which illustrates the application of a chemical sealing agent.

Referring now to FIG. 25, a view similar to FIG. 7 as illustrated except that a chemical seal is applied to the corner structure to seal capillary 71 and junctures 72. For this purpose, the opening 70 at the corner juncture may be sealed by means of Hypalon putty material 160 formed by dissolving Hypalon in suitable solvent, such as toluene, which upon evaporation leaves a solid mass of Hypalon material bonded to the fastener in halves and the exposed membrane of the surface 16. As illustrated in FIG. 25, this solvent may be placed in a solid mass approximately ¼ inch to ⅜ inch deep within the area bounded by dotted outline 62. The solvent in the dissolved material also dissolves the surface of the Hypalon fasteners as well as membrane 16 to provide an intimate bond. The resulting mass of Hypalon is subsequently fixed by the radiation of the sun and finally by the passage of time to provide an integral chemical seal for the corner joint. It is important to note the ends of the joint between the downwardly facing fastener halves and the upwardly facing fastener halves is exposed to ready access to the dissolved Hypalon material so that the ends of the capillaries extending along the length of the fastener grooves are sealed. Also, all other paths along the immediate surface of the various overlapped areas of Hypalon materials are similarly sealed.

It is preferred that a bottom plate 161 be placed under the ends of the fastener in FIG. 25 to prevent the passage of the Hypalon putty through opening 70 before it has completed its sealing function. Also, it is preferred that the ends of the downward facing fasteners 20 and 21 be tapered as in FIG. 22 to help ensure that as the Hypalon putty is forced into the area that the ends of the fasteners are not lifted up by or forced radially outward by the application of the putty material, and to provide a larger area of chemical sealing between the ends of the fasteners.

In addition to use with a roofing system as disclosed, the present invention may be used with other systems where it is necessary to provide a continuous membrane seal, such as in large bags. Also, the various apparatus described herein may take many different forms. For example, the upper plate 81 may be flat or other than dome-shaped. Also, a fluid-like sealant could be injected in the field through a pre-designed opening (such as provided by grease nipple) to fill the area within donut 82 instead of applying the softer mastic to the under surface of plate 81.

Thus, as should be evident from the above description of this invention, both a mechanical and a chemical seal is provided for sealing the corner joint (or other joint) between adjacent fastener ends of other members such as a plurality of flaps. As a result of the use of this invention a roof or other covering system can be provided with a continuous weatherproof, flexible membrane covering.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

While many possible embodiments may be made of the invention without departing from the scope thereof, it is to be understood that all matter herein set forth or shown in the accompanying drawings is to be interpreted as illustrative and not in a limiting sense.

What is claimed is:

1. A prefabricated roofing system comprising:

a group of panels contiguously arrayed in side-by-side and end-to-end abutting, junction-defining relationship on a supporting substructure, each panel including a first sheet metal member;

a second sheet metal member spaced from the first sheet metal member and disposed substantially parallel thereto;

a body of foam insulation substantially filling the space between and bonded to the first and second sheet metal members;

a thin, flexible, elastomer membrane extending over and being substantially continuously bonded to the first sheet metal members for forming a fluid-tight covering over the array of panels;

an extruded elastomer fastener connecting each edge of each of said membranes, said fasteners having end portions coverging towards each other defining an interstitial region at the junction of a plurality of said membranes; and, apparatus forming a sealed connection between said converging end portions, said apparatus including a first plate disposed below said fasteners, a second plate disposed above said fasteners, said first and second plates each having an interior side surface which overlaps said converging end portions, a viscous, adhesive sealing material the constituent particles of which flow in response to pressure applied to the interior side surface of at least one of said plates, and means clamping said plates together to cause the sealing material to flow between the plates into the interstitial region.

2. The roofing system as defined in claim 1 wherein said sealing material includes an annular layer of adhesive material having a consistency substantially equal to that of dough and a plug of adhesive material having a relatively softer consistency applied to the interior side surface area bounded by the annular layer.

3. The roofing system as defined in claim 1 wherein said first and second plates include openings in the center thereof and said last mentioned means includes a bolt disposed through said openings.

4. The roofing system as defined in claim 3 wherein said bolt is an expansion bolt.

5. The roofing system as defined in claim 3 wherein said bolt is threaded and further including at least one means for preventing relative rotation of said plates when the bolt is tightened.

6. The roofing system as defined in claim 1 wherein said second plate includes an opening in the center thereof and said last mentioned means is an upstanding stud extended from said first plate through said opening.

7. The roofing system as defined in claim 6 wherein said stud includes a plurality of radially projecting, resilient barbs to permit unilateral passage of the stud through the opening in said second plate, at least one of the barbs being disposed in locking engagement with the exterior side surface of said second plate.

8. The roofing system as defined in claim 6 wherein said stud and said opening are provided with cooperating threads and grooves, respectively, and further including means for preventing the relative rotation of said plates when said plates are drawn together as the stud is tightened within the grooved opening.

* * * * *

UNITED STATES PATENT OFFICE

CERTIFICATE OF CORRECTION

Patent No. 4,074,492 Dated February 21, 1978

Inventor(s) Harold G. Simpson and Michael W. Davis

It is certified that error appears in the above-identified patent and that said Letters Patent are hereby corrected as shown below:

Column 1, line 22, between "deck" and "typically", insert —,—.

Column 2, line 14, "buring" should be —burning—.

Column 3, line 57, "illustrated" should be —illustrates—.

Column 5, line 3, after "surface", "or" should be —of—.

Column 5, line 6, after "Flex Seal" insert —of—.

Column 5, line 7, "Comapny" should be —Company—.

Column 5, line 8, "Nemous" should be —Nemours—.

Figure 8:
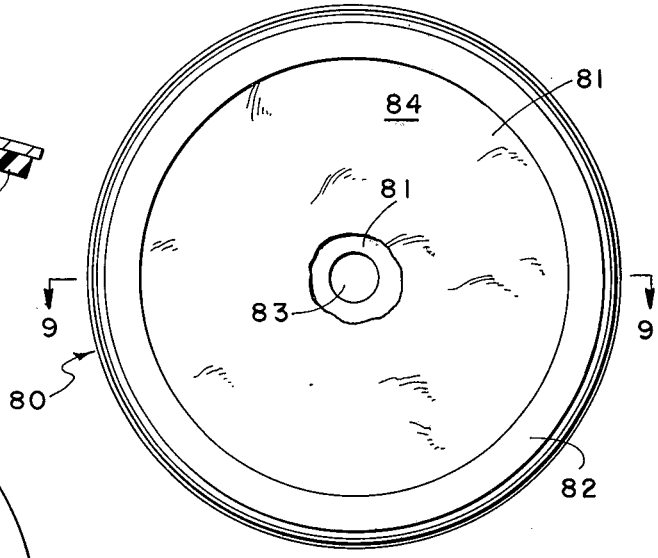
FIG. 8 is a bottom view of a preferred form of top plate for the clamp of this invention.

Column 7, line 30, "FIGS. 8 and 11" should be —FIGS. 8 through 11—.

Column 7, line 52, "then" should be —when—.

Column 9, line 64, "ends of" should be —ends or—.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*